US010472035B2

(12) United States Patent
Grant et al.

(10) Patent No.: US 10,472,035 B2
(45) Date of Patent: Nov. 12, 2019

(54) UNDERWATER VEHICLE

(71) Applicant: Autonomous Robotics Limited, Warminster, Wiltshire (GB)

(72) Inventors: David Alexander William Grant, Warminster (GB); Arran James Holloway, Warminster (GB)

(73) Assignee: AUTONOMOUS ROBOTICS LIMITED, Warminster (GB)

( * ) Notice: Subject to any disclaimer, the term of this patent is extended or adjusted under 35 U.S.C. 154(b) by 0 days.

(21) Appl. No.: 15/768,504

(22) PCT Filed: Oct. 14, 2016

(86) PCT No.: PCT/GB2016/053192
§ 371 (c)(1),
(2) Date: Apr. 13, 2018

(87) PCT Pub. No.: WO2017/064505
PCT Pub. Date: Apr. 20, 2017

(65) Prior Publication Data

US 2018/0297678 A1 Oct. 18, 2018

(30) Foreign Application Priority Data

Oct. 16, 2015 (GB) ..... 1518299.1

(51) Int. Cl.
*B63G 8/22* (2006.01)
*B63G 8/16* (2006.01)
(Continued)

(52) U.S. Cl.
CPC ..... *B63G 8/22* (2013.01); *B63B 27/36* (2013.01); *B63G 8/001* (2013.01); *B63G 8/14* (2013.01);
(Continued)

(58) Field of Classification Search
CPC . B63G 8/22; B63G 8/001; B63G 8/16; B63G 2008/004
See application file for complete search history.

(56) References Cited

U.S. PATENT DOCUMENTS 4,455,962 A * 6/1984 Gongwer ..... B63H 5/00 114/124
7,540,255 B2 6/2009 Hawkes
(Continued)

FOREIGN PATENT DOCUMENTS

EP 2 301 837 A1 3/2011
JP S63 59799 4/1988
(Continued)

OTHER PUBLICATIONS

Mar. 18, 2016 UKIPO Search Report for GB 15 18 299.1.
Dec. 16, 2016 ISR for PCT/GB2016/053192.
Dec. 16, 2016 Written Opinion of ISA for PCT/GB2016/053192.

*Primary Examiner* — Stephen P Avila
(74) *Attorney, Agent, or Firm* — Hahn Loeser & Parks, LLP

(57) ABSTRACT

An underwater vehicle comprising: port and starboard thrusters spaced apart in a port- starboard direction, each thruster being oriented to generate a thrust force in a fore-aft direction perpendicular to the port-starboard direction; a vertical thruster which is oriented to generate a thrust force substantially perpendicular to the fore-aft and port- starboard directions; port, starboard and vertical ducts which contain the port, starboard and vertical thrusters respectively, each duct providing a channel for water to flow through its respective thruster; and a moving mass which can be moved relative to the thrusters in the fore-aft direction to control a pitch of the underwater vehicle.

19 Claims, 7 Drawing Sheets

(51) Int. Cl.
*B63G 8/00* (2006.01)
*B63G 8/14* (2006.01)
*B63B 27/36* (2006.01)

(52) U.S. Cl.
CPC ..... *B63G 8/16* (2013.01); *B63G 2008/004* (2013.01)

(56) References Cited

U.S. PATENT DOCUMENTS

| | | | | |
|---|---|---|---|---|
| 2011/0266086 | A1* | 11/2011 | Welker | B63B 27/36 181/122 |
| 2013/0263770 | A1* | 10/2013 | Andersen | B63B 59/08 114/330 |

FOREIGN PATENT DOCUMENTS

| | | | |
|---|---|---|---|
| JP | H02 216389 | A | 8/1990 |
| JP | 2007-132769 | A | 5/2007 |
| WO | WO 97/20732 | | 6/1997 |
| WO | WO 2006/106085 | A1 | 12/2006 |
| WO | WO 2010/138759 | A2 | 2/2010 |
| WO | WO 2012/074408 | A2 | 6/2012 |
| WO | WO 2015/148729 | A1 | 10/2015 |

* cited by examiner

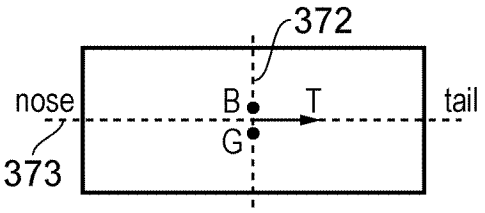
FIG. 14a
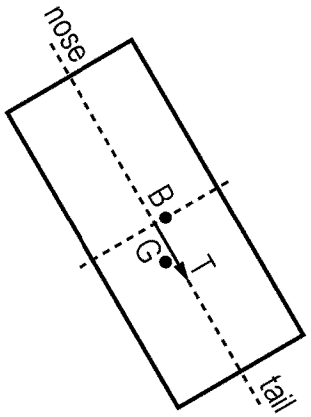
FIG. 14b
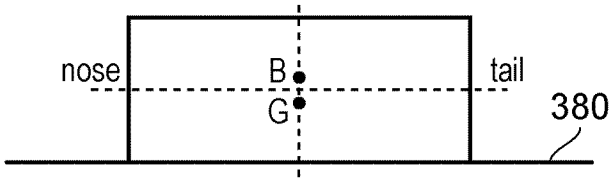
FIG. 14c
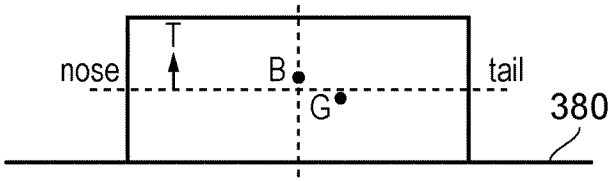
FIG. 14d
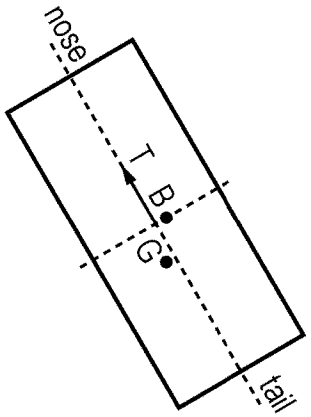
FIG. 14e
FIG. 14f

UNDERWATER VEHICLE

The present application is a submission under 35 U.S.C. § 371 of international application no. PCT/GB2016/053192, filed 14 Oct. 2016 and published in the English language with publication no. WO 2017/064505 A1 on 20 Apr. 2017, which claims the benefit of the filing date of GB 15 18299.1, filed 16 Oct. 2015, the contents of which are incorporated herein by reference.

FIELD OF THE INVENTION

The present invention relates to an underwater vehicle—that is, a vehicle which can be fully immersed in water.

BACKGROUND OF THE INVENTION

A known propulsion and steering mechanism for an underwater vehicle is described in U.S. Pat. No. 7,540,255. Two propellers are independently driven by motors, while the orientation of the propellers is simultaneously controlled by a third motor.

SUMMARY OF THE INVENTION

A first aspect of the invention provides an underwater vehicle comprising: port and starboard thrusters spaced apart in a port-starboard direction, each thruster being oriented to generate a thrust force in a fore-aft direction perpendicular to the port-starboard direction; a vertical thruster which is oriented to generate a thrust force substantially perpendicular to the fore-aft and port-starboard directions; port, starboard and vertical ducts which contain the port, starboard and vertical thrusters respectively, each duct providing a channel for water to flow through its respective thruster; and a moving mass which can be moved in the fore-aft direction to control a pitch of the underwater vehicle.

The vehicle of the first aspect has the unusual feature of having both a vertical thruster and a moving mass system. The vertical thruster can be used to effect vertical take-off and/or to achieve fine pitch control. The moving mass system can be used to effect pitch control over a long period. This makes the vehicle well suited to deep-sea operations such as seismic surveying, in which power consumption must be kept to a minimum. The vehicle may have two or more vertical thrusters, but more typically the vehicle has only three thrusters (the port thruster, the starboard thruster, and the vertical thruster). Typically the port and starboard thrusters are each reversible (so that their thrust forces can be switched between being directed forward and directed aft).

A second aspect of the invention provides an underwater vehicle comprising: a body with a nose and a tail at opposite ends of the underwater vehicle; port and starboard thrusters carried by the body, each thruster housed within a respective duct, each duct providing a channel for water to flow through its respective thruster (typically in a fore-aft direction) during operation of the thruster; and a moving mass system comprising a mass and an actuator for moving the mass relative to the body (typically forwards or backwards) to control a pitch of the AUV, wherein the AUV has a mid-plane (preferably perpendicular to the fore-aft direction) which lies half way between the nose and the tail and passes through both ducts, and wherein the thrusters are reversible so that they can be operated to generate forward thrust to drive the underwater vehicle forwards with the nose leading and operated to generate reverse thrust to drive the underwater vehicle backwards with the tail leading.

The vehicle of the second aspect can be driven forwards or backwards by the port and starboard thrusters, and the moving mass system provides a compact means of controlling pitch (i.e. moving the nose up relative to the tail, or vice versa). The vehicle is suited to a mission profile in which it descends tail first and ascends nose first (or vice versa). The combination of reversible thrusters and a moving mass system means that the vehicle can be made particularly compact in the fore-aft direction.

Various optional features are set out in the dependent claims. The following comments apply to the vehicle of either aspect of the invention.

The underwater vehicle may be an autonomous underwater vehicle (AUV) or a remotely operated vehicle (ROV) controlled via a tether. Typically the vehicle is un-manned.

The moving mass may be moved relative to the thrusters and/or a body of the underwater vehicle (AUV) in the fore-aft direction to control the pitch of the underwater vehicle.

Movement of the moving mass may be configured to determine the pitch of the underwater vehicle.

The underwater vehicle may further comprise an activator for moving the moving mass.

Typically the underwater vehicle has a maximum length L (typically in the fore-aft direction) and a maximum width W (typically in the port-starboard direction). Preferably $0.8<L/W<1.2$, and most preferably $0.9<L/W<1.1$.

Typically the underwater vehicle has a maximum length L (typically in the fore-aft direction), a maximum width W (typically in the port-starboard direction), and a maximum height H in a height direction perpendicular to the fore-aft and port-starboard directions. Preferably $W/H>1.5$ and $L/H>1.5$. Most preferably $W/H>1.8$ and $L/H>1.8$.

Typically $0.8<L/W<1.2$, $W/H>1.5$ and $L/H>1.5$.

Typically the vehicle has a body which carries the thrusters. The body of the underwater vehicle, and preferably the underwater vehicle as a whole (that is, including any shrouds, fairings, fins, control surfaces, thrusters or other protruding parts) has a planform external profile (that is, an external profile when viewed from above) which preferably has at least two lines of symmetry (a fore-aft line and a port-starboard line). This provides a hydrodynamic profile with similar drag characteristics regardless of whether the underwater vehicle is moving forwards or backwards The body of the AUV, and preferably the underwater vehicle as a whole (that is, including any shrouds, fairings, fins, control surfaces, thrusters or other protruding parts) has an external profile when viewed from the side with at least two lines of symmetry (a fore-aft line and a vertical line). This provides a hydrodynamic profile with similar drag characteristics regardless of whether the underwater vehicle is moving forwards or backwards.

The underwater vehicle may comprise a seismic sensor such as a geophone or hydrophone. Alternatively the vehicle may be used for other (non-seismic) sensing applications, as a communication device, or for other purposes.

The thrusters may be propellers, or devices which produce jets of water by another mechanism.

The underwater vehicle has a centre of buoyancy and a centre of gravity, and preferably the vertical thruster is positioned so that the thrust force generated by the vertical thruster is offset (typically forward or aft) from the centre of buoyancy and the centre of gravity. Typically the thrust force lies in a fore-aft plane of symmetry of the AUV.

The body of the vehicle may have only a single nose and a single tail at opposite ends of the underwater vehicle. Alternatively it may have multiple noses and/or multiple tails.

BRIEF DESCRIPTION OF THE DRAWINGS

Embodiments of the invention will now be described with reference to the accompanying drawings, in which:

FIGS. 14*a-f* show six stages in a mission of the AUV.

DETAILED DESCRIPTION OF EMBODIMENT(S)

Figure 1:
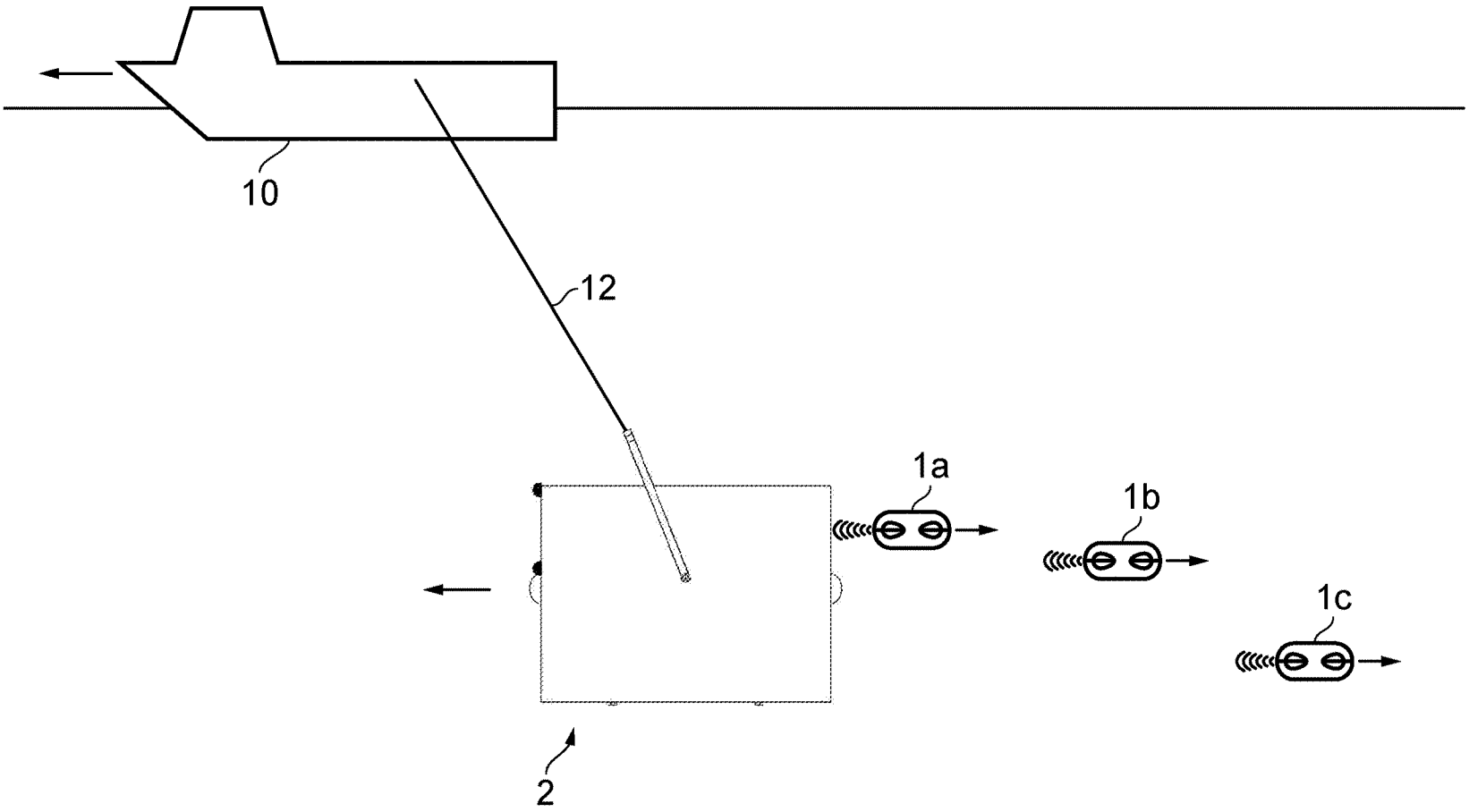
FIG. 1 shows a method of deploying autonomous underwater vehicles (AUVs)
Figure 2:
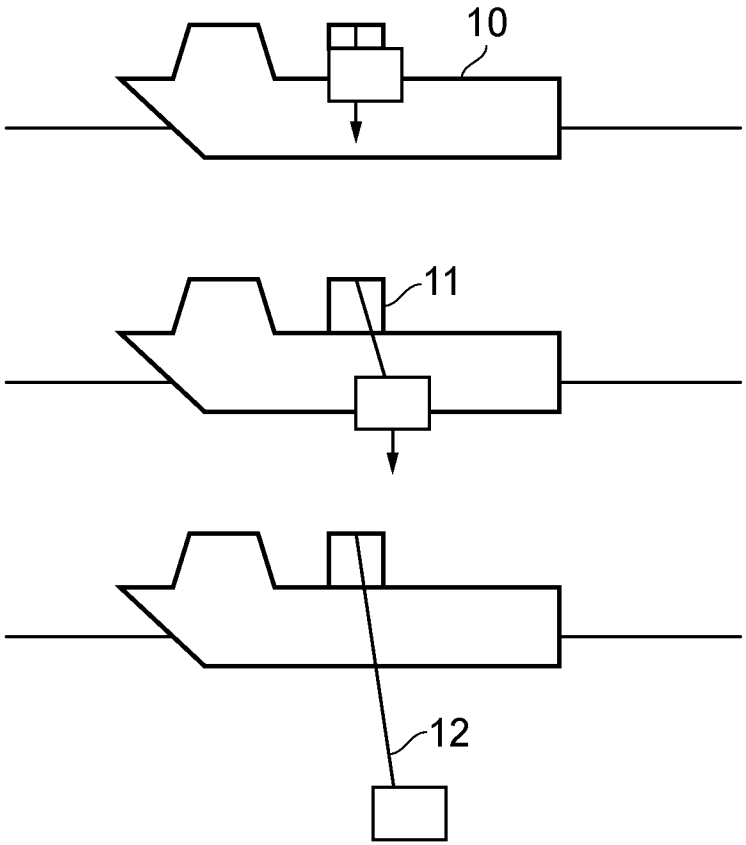
FIG. 2 shows a deployment/retrieval device being lowered into the water.

A method of deploying autonomous underwater vehicles (AUVs) 1*a-c* with a deployment/retrieval device 2 is shown in FIGS. 1 and 2. The device 2 is loaded with AUVs on the deck of a surface vessel 10. The device 2 carrying the AUVs is then lowered into the water by a crane 11 and a tether 12 as shown in FIG. 2 until it is at a required depth. At this point the surface vessel 10 may be stationary or it may be moving.

After the device 2 containing the AUVs has been submerged as in FIG. 2, the surface vessel 10 is driven to the left as shown in FIG. 1 so that it tows the submerged deployment device 2 containing the AUVs. The AUVs are then deployed one-by-one from the device 2 as it is towed by the surface vessel. The towing speed is typically between 0.5 m/s and 2.5 m/s, and most preferably between 1 m/s and 2 m/s. For example the towing speed may be 1.5 m/s. As the surface vessel moves, the AUVs are then deployed one-by-one from the device 2. As shown in FIG. 1, a thruster of each AUV 1*a-c* is operated after it has been deployed so that it moves horizontally away from the towed device 2.

Figure 3:
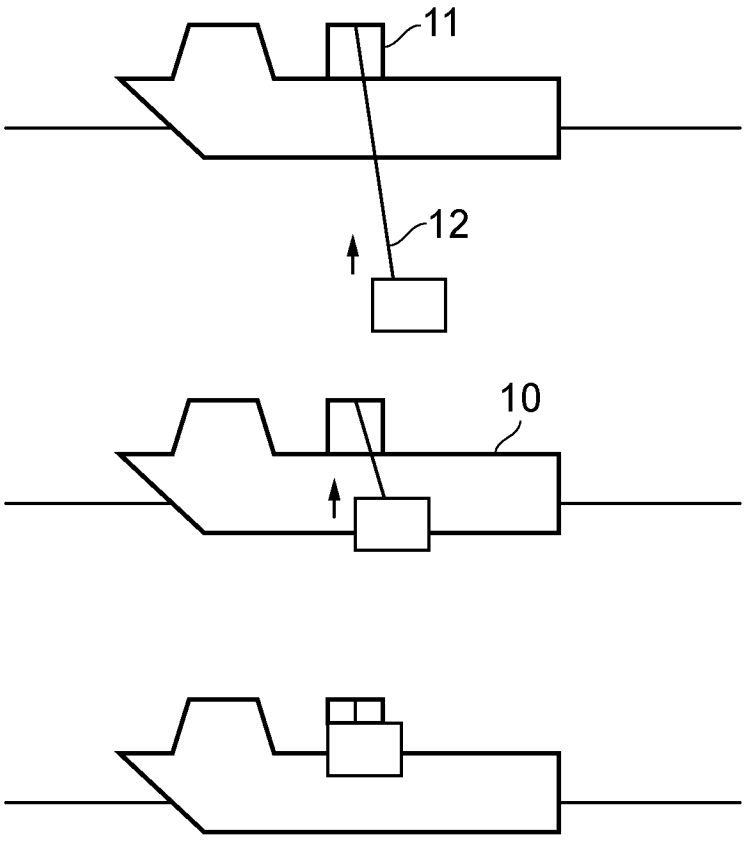
FIG. 3 shows a deployment/retrieval device being lifted from the water.
Figure 4:
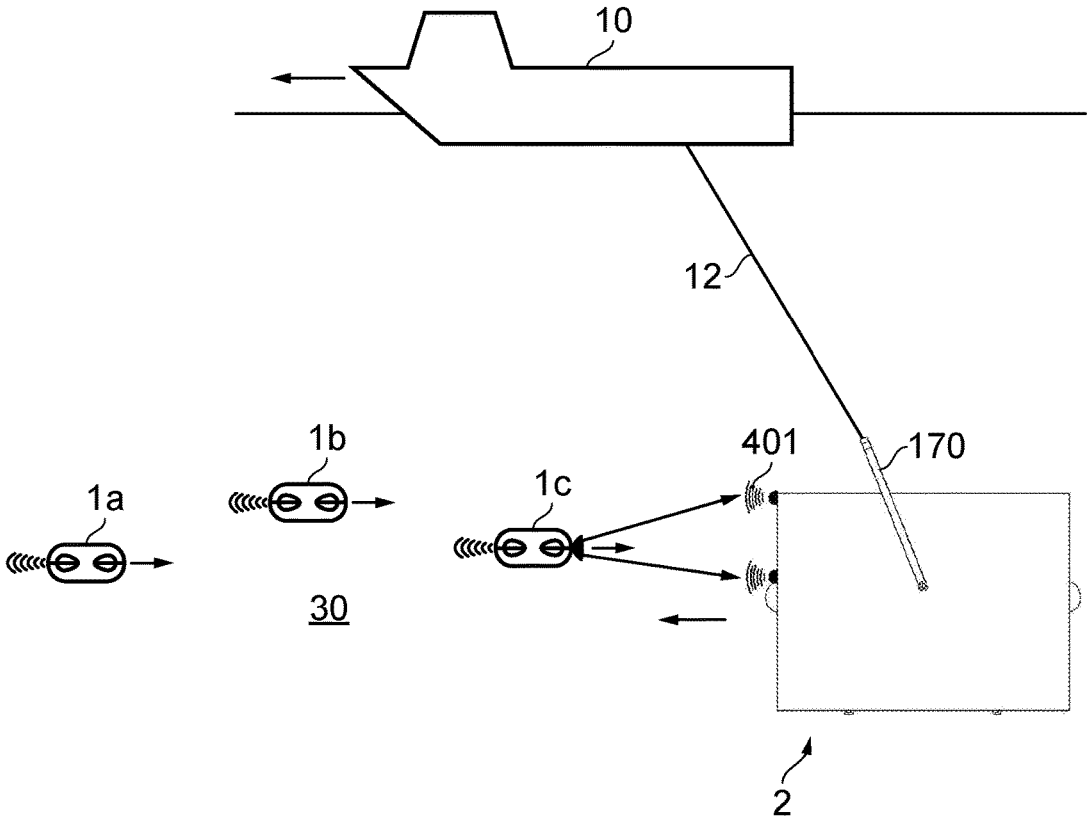
FIG. 4 shows a method of retrieving AUVs.

After the AUVs have been deployed as shown in FIG. 1, they descend autonomously to the seabed, and land at precisely controlled locations where they acquire seismic data during a seismic survey. When the survey is complete, the AUVs return to the surface vessel 10 where they are retrieved by essentially the reverse process to deployment, as shown in FIGS. 3 and 4. Thrusters of the AUVs are operated so that the AUVs form a line in front of the device in a retrieval zone 30 as shown in FIG. 4. The submerged device 2 is towed through the retrieval zone 30 by the surface vessel 10, and the AUVs are loaded one-by-one into the device 2 as it is towed through the retrieval zone 30 by the surface vessel. After the AUVs have been loaded into the towed device 2, the device 2 containing a full payload of the AUVs is lifted out of the water and onto the surface vessel by the crane 11 as shown in FIG. 3.

311, 312.

During the deployment process, the AUV is forced out of the device 2 by the action of the water flowing through the device 2. That is—the towing motion causes a flow of water through the device 2 and this flow generates a motive force which ejects the AUV out of the device. Optionally the AUV may also operate its thrusters to assist its ejection from the device 2.

Homing devices, such as acoustic transmitters, are arranged to output homing signals 401 (such as acoustic signals) which guide the AUVs to the device during the retrieval process as shown in FIG. 4.

The AUV may optionally operate its thrusters as shown in FIG. 1 to force it into the device 2, or it may be stationary and "swallowed up" by the towed device 2.

When the device 2 is full, it is lifted up onto the deck of the surface vessel as shown in FIG. 3.

A similar process is followed during deployment. That is: the device 2 is lowered into the water with a full payload of AUVs as shown in FIG. 2; the AUVs are deployed as in FIG. 1; the empty device 2 is lifted up onto the deck of the surface vessel; AUVs are loaded onto the device 2 which is submerged and towed to deploy a further batch of AUVs.

To sum up: the submersible device 2 can be used to deploy and/or retrieve AUVs. FIGS. 5-13 show an exemplary one of the AUVs 1*a* in detail. The AUV comprises a body with a nose 371 and a tail 370 at opposite ends of the AUV. The body of the AUV comprises a cylindrical pressure vessel 300 (FIG. 10) contained within a housing formed by upper and lower shells 320, 330. The pressure vessel 300 contains batteries 302 and three orthogonally oriented seismic sensors 301 (FIG. 8). Starboard and port horizontal thrusters 310*a,b* are carried by the body and can be operated to propel the AUV forward and backwards. A single vertical thruster 311 is also carried by the body and can be operated to control the pitch angle of the AUV and effect a vertical take-off from the seabed as will be described in further detail below. Each thruster 310*a,b,* 311 comprises a propeller housed within a respective duct.

The pressure vessel and thrusters are contained within a housing formed by the upper and lower shells 320, 330 which meet at respective edges around the circumference of the AUV. The upper shell 320 forms a downward-facing cup and the lower shell 330 forms an upward-facing cup. The shells 320, 330 together provide a hydrodynamic hull of the AUV, including a port shroud 360 (FIG. 6) which shrouds the port thruster 310*b,* a starboard shroud 361 which shrouds the starboard thruster 310*a,* and a vertical shroud 362 which shrouds the vertical thruster 311.

Figure 12:
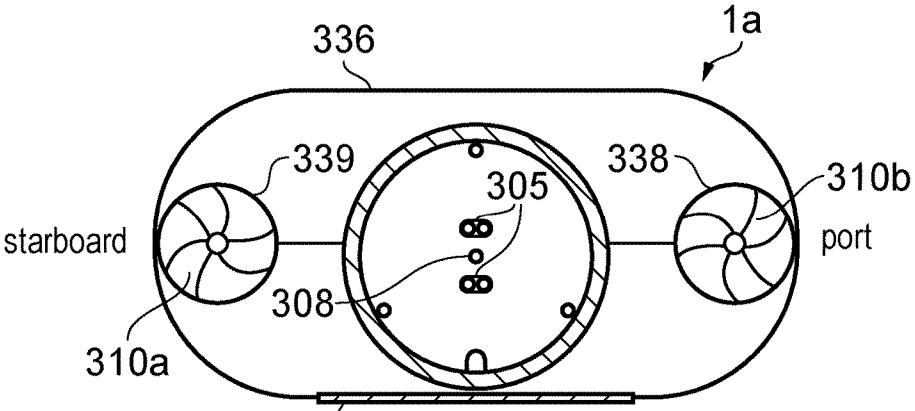
FIG. 12 is a cross-sectional view of the AUV viewed from the front.

The shells 320, 330 together provide three ducts which contain the three thrusters 310*a,b,* 311. A vertical duct 332 (FIG. 8) contains the vertical thruster 311 as shown in FIG. 8. The vertical duct 332 has an opening 331 in the upper shell and an opening 334 in the lower shell, and provides a vertically oriented channel for water to flow through the vertical thruster 311 when it is generating vertical thrust. The vertical duct 332 is bounded by a wall 333 which is circular in cross-section transverse to the flow direction through the duct. Each shell 320, 330 also has four recesses formed in its edge where it meets the other shell, the eight recesses together providing four openings 321-324 for port and starboard horizontal ducts 338, 339 (FIG. 12) which contain the horizontal thrusters. Each horizontal duct has a respective forward opening 322, 323 (FIG. 5) at a forward end of the duct and an aft opening 321, 324 (FIG. 11) at an aft end of the duct. As shown in FIG. 12, the horizontal ducts 338, 339 are circular in cross-section transverse to the flow direction through the duct. The port duct 338, 323, 324 provides a channel for water to flow through the port thruster 310*b*, and the starboard duct 339, 321, 322 provides a channel for water to flow through the starboard thruster 310*a*.

The lower shell 330 includes a planar disc 335. The disc 335 acts as a base for the AUV, with a substantially planar downward-facing external surface which can provide a stable platform for the AUV when it is sitting on a platform segment 130 or on the seabed. The upper shell includes an upper skin 336 opposite the disc 335 with a substantially planar upward-facing external surface. Thus the AUV can land upside down if necessary. The disc 335 and upper skin 336 also have substantially planar internal faces—this maximises the internal space of the AUV.

The batteries 302 can be moved relative to the rest of the AUV in a fore-aft direction 351 to control a pitch angle of the AUV. The batteries 302 slide fore-and aft on rails 305 shown in FIGS. 8 and 12. In FIG. 8 the batteries 302 are positioned fully aft but they can be moved forward until they engage a plate 306 towards the front of the pressure vessel in order to reduce the angle of pitch of the AUV. The range of travel of the batteries 302 is sufficient to adjust the pitch of the AUV from 0° (level) to 60° (nose up). When the batteries are positioned fully aft as in FIG. 8 the pitch angle is 60° (with the nose 371 pointing up).

The batteries are moved by an actuation system comprising a motor 307 which engages a lead screw 308, rotation of the motor 307 driving the motor 307 and the batteries 302 fore and aft.

The horizontal thrusters 310*a,b* are spaced apart in a port-starboard direction 350 shown in FIGS. 23 and 28. Each horizontal thruster is oriented to generate a thrust force in a fore-aft direction 351 perpendicular to the port-starboard direction 350. The port and starboard ducts 338, 339 are aligned parallel with this fore-aft thrust direction 351. The vertical thruster 311 is oriented to generate a thrust force in a height direction 352 (FIG. 5) perpendicular to the fore-aft and port-starboard directions 350, 351. The vertical duct 332 is aligned parallel with this vertical thrust direction 352.

Figure 10:
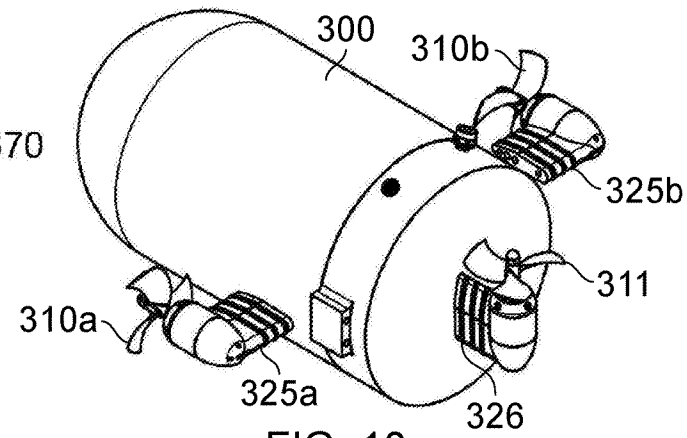
FIG. 10 is an isometric view of the pressure vessel and thrusters.

The horizontal thrusters 310*a,b* are each reversible (i.e. they can be spun clock-wise or anti-clockwise) so that their thrust forces can be switched between being directed forward and being directed aft. As shown in FIG. 10, the pressure vessel 300 carries the horizontal thrusters on struts 325*a,b* on the starboard and port sides of the pressure vessel 300. The struts 325*a,b* are fixed, so the orientations of the horizontal thrusters 310*a,b* are fixed relative to the pressure vessel and the rest of the AUV. Therefore their thrust forces cannot be re-oriented relative to the rest of the AUV at an angle from the fore-aft direction 351. The horizontal thrusters 310*a,b* can be driven together to drive the AUV forwards or backwards, or driven differentially to control its yaw angle.

In an alternative embodiment (not shown) the horizontal thrusters 310*a,b* may be thrust-vectored like the thrusters in U.S. Pat. No. 7,540,255—that is, their thrust forces can be re-oriented at an angle from the fore-aft direction (for instance to effect vertical take-off). However this is less preferred because it would make them more complex, and more difficult to shroud compactly.

A typical mission profile for the AUV is shown in FIG. 14. The AUV has a centre of gravity (G) below its centre of buoyance (B). During deployment (FIG. 14*a*) the batteries 302 are positioned fully forward so the pitch angle of the AUV is 0°, and the horizontal thrusters generate a thrust T which can either drive the AUV backwards (tail first) out of the deployment/retrieval device 2 as shown in FIG. 14*b*, or forwards (nose first). On descent (FIG. 14*b*) the batteries 302 are moved aft so the pitch angle of the AUV increases to 60°, and the horizontal thrusters are operated to generate a thrust T which drives the AUV backwards (tail first). On arriving at the seabed 380 (FIG. 14*c*) the batteries 302 are moved forward so the pitch angle of the AUV returns to 0° and the AUV rests stably on the seabed. To take off (FIG. 14*d*) the batteries 302 are moved aft and a vertical thrust T from the vertical thruster 311 causes the AUV to lift off and pitch nose up. On ascent (FIG. 14*e*) the vertical thruster 311 is turned off and the horizontal thrusters generate a thrust T which drives the AUV forwards (nose first) with its nose up. Finally, the AUV is retrieved by the device 2 as in FIG. 13*f* with its batteries 302 moved forward so the pitch angle is 0°.

The vertical thruster 311 is positioned so that its thrust force is offset forward from the centre of gravity (G) and centre of buoyancy (B), so that as well as being used to effect vertical take-off as in FIG. 14*d* it can also be used to achieve fine pitch control.

However this method of pitch control is not efficient over a long period, hence the use of a moving mass (in this case, the batteries 302) as a more efficient method of controlling the steady state pitch of the AUV during descent and ascent. The moving mass allows the centre of gravity to be moved near to the centre (level pitch) for deployment and recovery (FIGS. 14*a,f*) and when the AUV is on the seabed (FIG. 14*c*). Having the centre of gravity central on the seabed means the moment arm acting on the AUV from ocean currents is the same regardless of the direction of the ocean current.

The AUV is designed to travel efficiently both forwards and backwards. If this was not the case, the AUV would need to be capable of adjusting its pitch from −60° to 60° during a mission instead of from 0° to 60°. This would increase the amount of space required for the moving mass system and hence would increase the maximum fore-aft length of the AUV.

The AUV includes a buoyancy control system (not shown) for controlling its buoyancy during the mission. The buoyancy control system is preferably housed in the space between the pressure vessel 300 and the upper and lower shells 320, 330. The buoyancy control system may be, for example, an active system which is operated to make the AUV neutrally buoyant during deployment/retrieval (FIGS. 14*a,f*), negatively buoyant during descent (FIG. 14*b*) and during a seismic survey (FIG. 14*c*), and positively buoyant during ascent (FIG. 14*e*).

Figure 13:
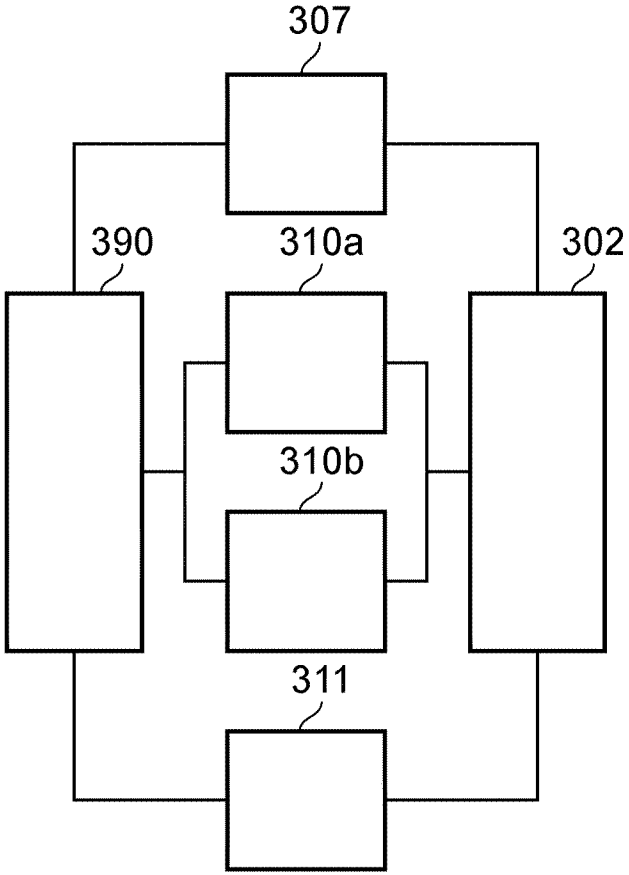
FIG. 13 is a schematic view of the AUV control system.
Figure 11:
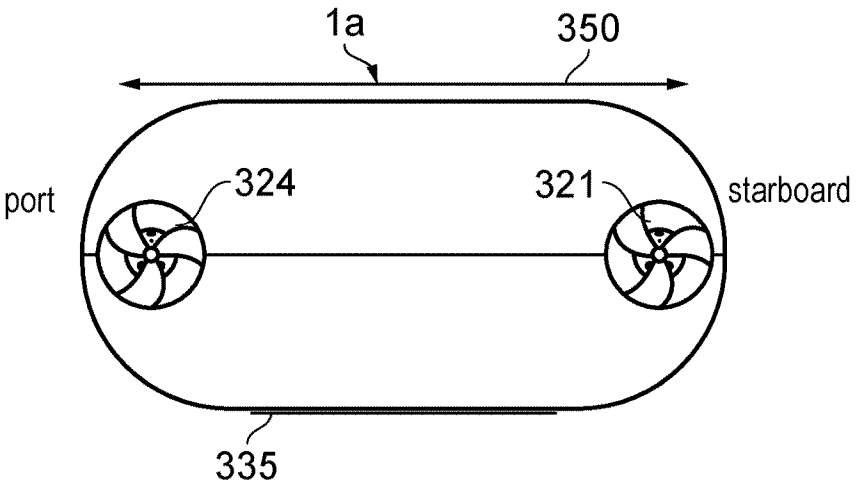
FIG. 11 is a rear view of the AUV.

FIG. 13 is a schematic view of a control system for controlling the thrusters and moving mass. The pressure vessel 300 contains a controller 390 which is programmed to autonomously control the thrusters 310*a*, 310*b*, 311 and the motor 307 in order to follow the mission profile shown in FIG. 13. That is, the controller 390 is arranged to operate the horizontal thrusters to generate forward thrust to drive the AUV forwards with the nose leading during ascent, and also arranged to operate the thrusters to generate reverse thrust to drive the AUV backwards with the tail leading during descent. The batteries 302 supply power to the thrusters 310*a*, 310*b*, 311 and the motor 307.

Figure 6:
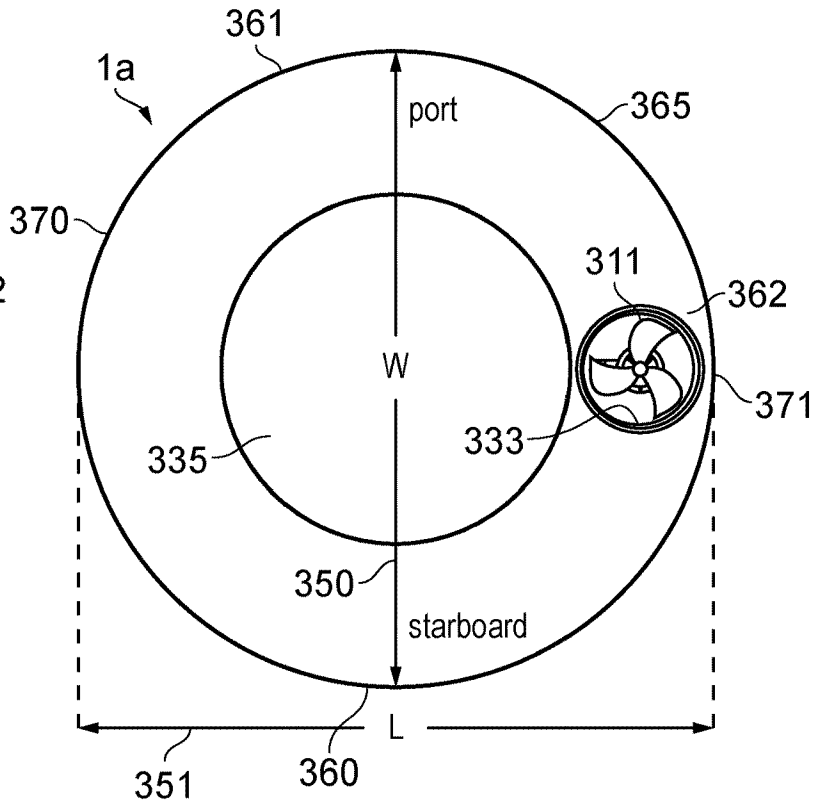
FIG. 6 is a plan view of the AUV showing its planform profile.
Figure 5:
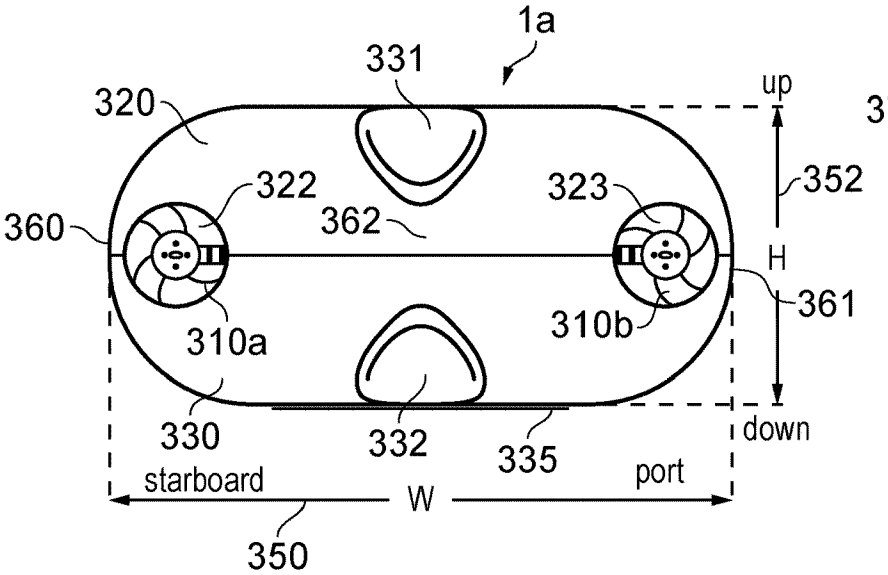
FIG. 5 is a front view of an AUV.
Figure 9:
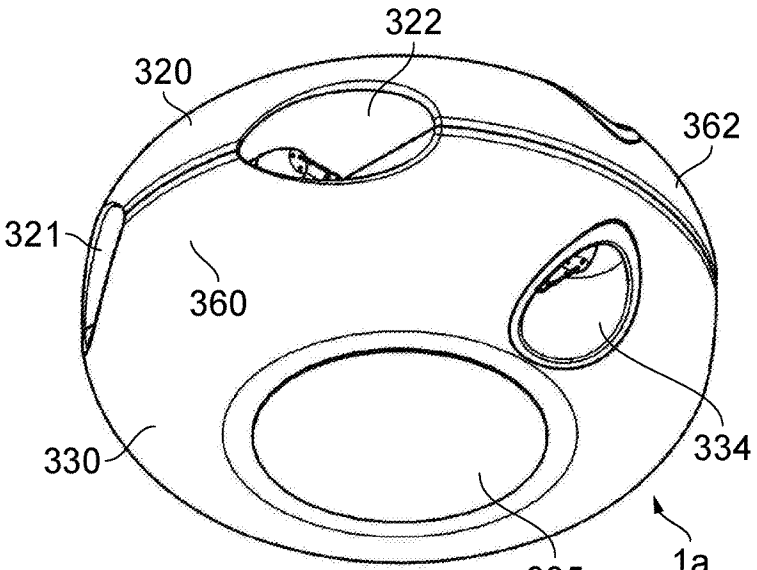
FIG. 9 is an isometric view of the AUV.
Figure 7:
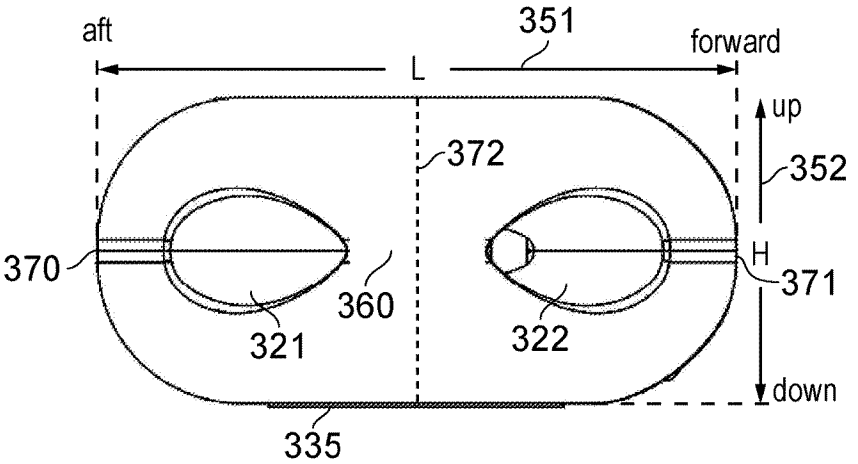
FIG. 7 is a starboard side view of the AUV.
Figure 8:
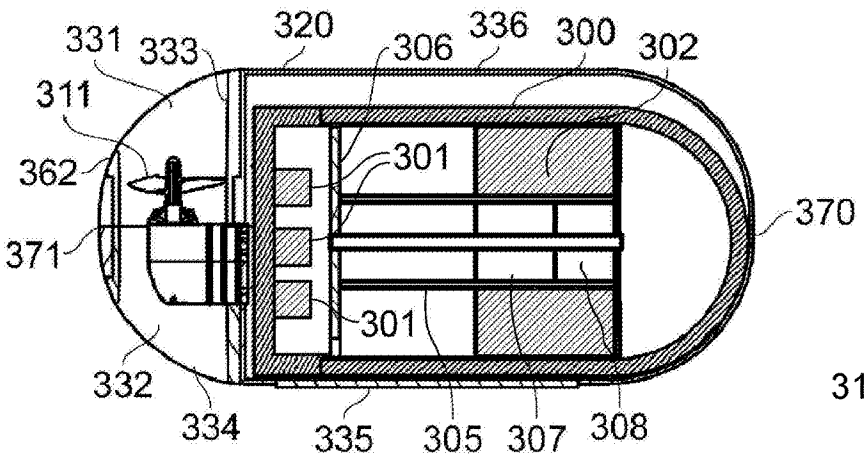
FIG. 8 is a cross-sectional view of the AUV viewed from the port side.

The AUV has a maximum length L in the fore-aft direction as shown in FIGS. 6 and 7. The nose 371 and a tail 370 at opposite ends of the AUV are spaced apart in the fore-aft direction 351 by this maximum length L. Each horizontal thruster is housed within a respective horizontal duct 338, 339 with a forward duct opening 322, 323 at a forward end of the duct and an aft duct opening 321, 324 at an aft end of the duct. Each horizontal duct provides a channel for water to flow through its respective thruster in the fore-aft direction 351 during operation of the thruster. The motor 307 moves the batteries 302 relative to the body (forwards or backwards) to control a pitch of the AUV. The AUV has a fore-aft mid-plane 372 (shown in FIGS. 7 and 14*a*) which is perpendicular to the fore-aft direction 351 and lies half way between the nose 371 and the tail 370. The mid-plane 372 is also a perpendicular bisector of a fore-aft line between the nose and the tail.

The propellers of the horizontal thrusters are positioned on this mid-plane 372, and the mid-plane 372 also passes through both horizontal ducts 338, 339 as shown in FIG. 12 (which is a cross-section taken along the mid-plane 372). This amidships position of the horizontal thrusters (and their associated ducts) enables them to operate relatively efficiently whether they are driving the AUV forwards or backwards.

Although the horizontal thrusters 310*a*, b are positioned symmetrically (i.e. on the mid-plane 372) the horizontal thrusters 310*a,b* themselves are not symmetrical and they are more efficient when directing a thrust force which moves the AUV forwards. Since they must overcome gravity when the AUV is ascending, the horizontal thrusters are therefore used to drive the AUV forwards when it is ascending and backwards when it is descending (rather than vice versa).

In an alternative embodiment the horizontal thrusters 310*a,b* could be positioned towards the tail of the vehicle, or they could actuated so that they move to the nose or tail of the vehicle depending on the direction of travel. Although these thruster positions would be more efficient, the thrusters would be more difficult to shroud and they would need to protrude from the body of the AUV.

The vertical thruster 311 is also reversible (i.e. it can be spun clock-wise or anti-clockwise) so its thrust force can be switched between being directed up and down. However, it works most efficiently when the thrust is directed up to propel the nose of the AUV up as in FIG. 14*d* to effect vertical take-off from the seabed. As shown in FIG. 10, the pressure vessel 300 carries the vertical thruster on a strut 326 at the forward end of the pressure vessel 300. The strut 326 is fixed, so the orientation of the vertical thruster 311 is fixed relative to the pressure vessel 300 and the rest of the AUV. Therefore its thrust force cannot be re-oriented at an angle from the vertical direction 352.

In an alternative embodiment (not shown) the vertical thruster 311 may be thrust-vectored—that is, its thrust force can be re-oriented at an angle from the vertical direction relative to the pressure vessel 300 and the rest of the body of the AUV. However this is less preferred because it would make it more difficult to shroud compactly.

The overall shape of the AUV is a circular disc, and various significant aspects of its shape will now be discussed.

The port and starboard shrouds 360, 361 have a convex planform external profile when viewed from above in the height direction as in FIG. 6. Similarly the vertical shroud 362 at the tail of the AUV has a convex planform external profile when viewed from above in the height direction as in FIG. 6.

As can be seen in FIG. 6, the AUV (including the shrouds 360, 361, 371) has a substantially circular planform external profile when viewed from above in the height direction, except where the shells 320, 330 are cut away to provide the openings for the horizontal thrusters (these cut-away regions presenting a straight planform profile as indicated in FIG. 6 at 365, rather than a circular planform profile).

As can also be seen in FIG. 6 the AUV has a maximum length L in the fore-aft direction which is approximately equal to its maximum width W in the port-starboard direction. In other words the length-to-width aspect ratio (L/W) of the AUV is approximately one. This aspect ratio provides a number of advantages. Firstly—it enables the AUVs to be packed together efficiently when they are stored in the deployment/retrieval device 2, on the deck of the surface vessel 10, or at another storage location. Secondly—it enables the AUV to be easily rotated about a vertical axis in a confined space. It enables the AUV to rotate within the confined space of the device 2 during underwater deployment—operating its horizontal thrusters differentially to orient it in the correct direction with its nose or tail pointing out of the deployment funnel. Thirdly, when the AUV arrives at the seabed it can land in any orientation regardless of the direction of ocean currents. This can be contrasted with an AUV with a higher aspect ratio (L>>W) which would present a higher drag profile to width-wise (port-starboard) currents than to length-wise (fore-aft) currents and hence must land with its length running parallel with the ocean currents to prevent it from being disturbed by them during the seismic survey.

Note that the AUV has no protruding parts such as fins, control surfaces, thrusters etc. which protrude from the side, front or back of the body of the AUV. Any such protruding parts might break during operation of the AUV. If such protruding parts are included in an alternative embodiment, then the length-to-width aspect ratio (L/W) of the AUV—including the protruding parts—may deviate from unity by up to 20%. In other words, in such an alternative embodiment $0.8<L/W<1.2$. Alternatively the AUV may remain with no protruding parts but be shaped with a more elongated planform profile.

The AUV has a relatively small height relative to its length and width. In other words the AUV has a maximum height H in the height direction, and the maximum width (W) and maximum length (L) are both higher than the maximum height H. So with reference to FIG. 5 the AUV has a maximum height H between the disk 335 at the base of the AUV and the upper skin 336, a maximum width W between the port and starboard extremities of the shrouds 360, 361, and the width-to-height aspect ratio (W/H) is approximately 2.1. Similarly, with reference to FIG. 7, the AUV has a maximum length L between the nose 371 and tail 370, and the length-to-height aspect ratio (L/H) is approximately 2.1. This relatively small height provides the benefit of presenting relatively low drag to ocean currents when the AUV is stationed on the seabed, and also makes it less likely to being disturbed on the seabed by trawls and dredges.

Note that the AUV has no protruding parts such as fins, control surfaces, thrusters etc. which protrude from the top or bottom of the body of the AUV. Any such protruding parts might break during operation of the AUV. If such protruding parts are included in an alternative embodiment, then the height—including the protruding parts—may increase so the aspect ratios L/H and W/H may reduce to as low as 1.5. Alternatively the AUV may remain with no protruding parts but be shaped with a more heightened profile.

The body 300, 320, 330 of the AUV, and preferably the AUV as a whole (that is, including any shrouds, fairings, fins, control surfaces, thrusters or other protruding parts) has a planform external profile (that is, an external profile when viewed from above as in FIG. 6) with two lines of symmetry: a fore-aft line of symmetry running between the nose 371 and the tail 370, and a port-starboard line of symmetry running between the shrouds 360, 361. This provides a symmetrical hydrodynamic profile with similar drag characteristics regardless of whether the AUV is moving forwards or backwards.

Similarly the body 300, 320, 330 of the AUV, and preferably the AUV as a whole (that is, including any shrouds, fairings, fins, control surfaces, thrusters or other protruding parts) has an external profile when viewed from the side (as in FIG. 10) with at least two lines of symmetry: a fore-aft line of symmetry 373 shown in FIG. 14*a* running between the nose 371 and the tail 370, and a vertical line of symmetry running vertically from top to bottom (in the mid-plane 372). This also provides a symmetrical hydrodynamic profile with similar drag characteristics regardless of whether the AUV is moving forwards or backwards.

The openings 321-324 in the horizontal ducts have peripheral edges which are swept by 45° relative to the port-starboard direction (as can be seen by the 45° angle of the line 365 in FIG. 6) so that they are visible around their full circumference when viewed in the port-starboard direction as in FIG. 7. Similarly the top and bottom openings of the vertical duct have peripheral edges which lie at an angle to the fore-aft direction so that they are visible around their full circumference when viewed in the fore-aft direction as in FIG. 5.

Although the invention has been described above with reference to one or more preferred embodiments, it will be appreciated that various changes or modifications may be made without departing from the scope of the invention as defined in the appended claims.

The invention claimed is:

1. An underwater vehicle comprising:

port and starboard thrusters spaced apart in a port-starboard direction, each thruster being oriented to generate a thrust force in a fore-aft direction perpendicular to the port-starboard direction;

a vertical thruster which is oriented to generate a thrust force substantially perpendicular to the fore-aft and port-starboard directions;

port, starboard and vertical ducts which contain the port, starboard and vertical thrusters, respectively, each duct providing a channel for water to flow through its respective thruster; and a moving mass which can be moved in the fore-aft direction to control a pitch of the underwater vehicle, wherein the moving mass comprises one or more batteries.

2. The underwater vehicle of claim 1, wherein the moving mass can be moved relative to the thrusters in the fore-aft direction to control the pitch of the underwater vehicle.

3. The underwater vehicle of claim 1, wherein movement of the moving mass is configured to determine the pitch of the underwater vehicle.

4. The underwater vehicle of claim 1, further comprising an actuator for moving the moving mass.

5. The underwater vehicle of claim 1, wherein the underwater vehicle has a maximum length L in the fore-aft direction and a maximum width W in the port-starboard direction; and wherein $0.8<L/W<1.2$.

6. The underwater vehicle of claim 1, wherein the underwater vehicle has a maximum length L in the fore-aft direction, a maximum width W in the port-starboard direction, and a maximum height H in the height direction; and wherein: $W/H>1.5$ and $L/H>1.5$.

7. The underwater vehicle of claim 1, wherein the underwater vehicle has a maximum length L in the fore-aft direction, a maximum width W in the port-starboard direction, and a maximum height H in the height direction; and wherein: $0.8<L/W<1.2$, $W/H>1.5$, and $L/H>1.5$.

8. The underwater vehicle of claim 1, wherein the vertical thruster is shrouded by a vertical shroud having a convex planform external profile when viewed from above in the height direction.

9. The underwater vehicle of claim 1, wherein the underwater vehicle has a centre of buoyancy and a centre of gravity, and the vertical thruster is positioned so that the thrust force generated by the vertical thruster is offset from the centre of buoyancy and the centre of gravity.

10. The underwater vehicle of claim 1, further comprising a body which carries the vertical thruster, wherein an orientation of the vertical thruster is fixed relative to the body so that the thrust force of the vertical thruster cannot be re-oriented from the vertical direction.

11. The underwater vehicle of claim 9, wherein the underwater vehicle has a mid-plane which lies half way between a nose and a tail and passes through the port duct and the starboard duct, and the port and starboard thrusters are reversible so that they can be operated to generate forward thrust to drive the underwater vehicle forwards with the nose leading and operated to generate reverse thrust to drive the underwater vehicle backwards with the tail leading.

12. The underwater vehicle of claim 1, further comprising a seismic sensor.

13. The underwater vehicle of claim 1, further comprising a base with a substantially planar downward-facing external surface which can provide a stable platform for the underwater vehicle.

14. The underwater vehicle of claim 1, further comprising upper and lower shells which meet at respective edges and together provide an external hull of the underwater vehicle.

15. The underwater vehicle of claim 14 wherein the upper shell forms a downward-facing cup and the lower shell forms an upward-facing cup.

16. The underwater vehicle of claim 1, further comprising a body which carries the port and starboard thrusters, wherein orientations of the port and starboard thrusters are fixed relative to the body so that the thrust forces of the port and starboard thrusters cannot be re-oriented.

17. An underwater vehicle comprising:

a nose and a tail at opposite ends of the underwater vehicle;

port and starboard thrusters spaced apart in a port-starboard direction, each thruster being oriented to generate a thrust force in a fore-aft direction perpendicular to the port-starboard direction;

a vertical thruster which is oriented to generate a thrust force substantially perpendicular to the fore-aft and port-starboard directions; and a moving mass which can be moved in the fore-aft direction to control a pitch of the underwater vehicle;

wherein the underwater vehicle is configured to land on a seabed and the vertical thruster is arranged to control a pitch of the underwater vehicle when the underwater vehicle is on the seabed.

18. An underwater vehicle comprising:

port and starboard thrusters spaced apart in a port-starboard direction, each of the port and starboard thrusters being oriented to generate a thrust force in a fore-aft direction perpendicular to the port-starboard direction;

a vertical thruster which is oriented to generate a thrust force substantially perpendicular to the fore-aft and port-starboard directions; and a moving mass which can be moved in the fore-aft direction to control a pitch of the underwater vehicle;

wherein the vertical thruster is operable to control a pitch of the underwater vehicle; and wherein the underwater vehicle has a centre of buoyancy and a centre of gravity, and the vertical thruster is positioned so that the thrust force generated by the vertical thruster is offset from the centre of buoyancy and the centre of gravity.

19. The underwater vehicle of claim 18, wherein the underwater vehicle has a nose and a tail at opposite ends of the underwater vehicle in the fore-aft direction, and the vertical thruster is proximate to one of the nose and the tail.

* * * * *